United States Patent [19]

Sternberg

[11] Patent Number: 4,468,870

[45] Date of Patent: Sep. 4, 1984

[54] BOWLING SHOE

[76] Inventor: Joseph E. Sternberg, 2198 Sycamore Hill Ct., Chesterfield, Mo. 63017

[21] Appl. No.: 460,197

[22] Filed: Jan. 24, 1983

[51] Int. Cl.[3] ..... A43B 5/00

[52] U.S. Cl. ..... 36/130

[58] Field of Search ..... 36/130, 127

[56] References Cited

U.S. PATENT DOCUMENTS

| | | | |
|---|---|---|---|
| 1,870,751 | 8/1932 | Reach | 36/127 |
| 2,078,626 | 4/1937 | Bauer | 36/127 |
| 4,118,034 | 10/1978 | O'Brien | 36/127 |
| 4,180,924 | 1/1980 | Subotnick | 36/127 |
| 4,369,589 | 1/1983 | Summey | 36/130 |

*Primary Examiner*—Werner H. Schroeder

*Attorney, Agent, or Firm*—Cohn, Powell & Hind

[57] ABSTRACT

This bowling shoe includes an upper portion and a lower portion attached to the upper portion. The inside edge of the lower portion projects outwardly from the line of attachment a conventional amount but the outside edge of the lower portion projects outwardly from the line of attachment a substantially greater amount than inside edge, to support the foot of the wearer during play. The outside edge is tapered to facilitate the support action.

8 Claims, 5 Drawing Figures

BOWLING SHOE

BACKGROUND OF THE INVENTION

This invention relates generally to bowling shoes and particularly to a bowling shoe having a greater than conventional outer edge portion to provide support for the foot of the wearer during play.

Various training aids have been devised for incorporation into footwear to increase stability. For example, U.S. Pat. No. 2,724,193 discloses a walking aid for children in the nature of a pair of stiff platforms which are strapped to the foot and provide a forward and also a lateral outward extension, of an amount about the foot width, sufficient to prevent the child falling either to the side or forwardly. In the sports area a spiked attachment for a golf shoe is disclosed in U.S. Pat. No. 2,179,942 which is secured to the inside of the shoe to provide a curved pivotal face which causes the knees of the wearer to be directed toward each other.

SUMMARY OF THE INVENTION

This bowling shoe provides support for the outside of the foot of the player by means of an outward projection of the bottom of the shoe which is substantially greater than that of a conventional shoe.

The bowling shoe includes an upper portion having inner and outer sides providing oppositely disposed longitudinally extending inner and outer side margin portions; a lower flexible portion including oppositely disposed longitudinally extending inner and outer side portions attached to corresponding lower side margin portions of the upper portion; the longitudinally extending inner side portion projecting outwardly of the attached inner side margin portion at the point of attachment and the longitudinally extending outer side portion projecting outwardly of the attached outer side margin portion at the point of attachment, for at least a substantial portion of the length thereof, a greater amount than said opposite inner side portion, said outer side portion projection being substantially between the percent (10%) to thirty percent (30%) of the transverse distance between oppositely disposed inner and outer margins at the point of attachment of the lower portion to the upper portion to provide support for the outside edge of the foot of the wearer during play.

In one aspect of the invention the longitudinally extending outer support portion includes an upper margin and a lower margin said lower margin being disposed outwardly of said upper margin to define a tapered edge of the support portion. In another aspect of the invention the angle of the taper is substantially forty-five degrees (45°).

In still another aspect of the invention the longitudinally extending outer support portion extends at least substantially the length of the sole.

In yet another aspect of the invention the longitudinally extending outer support portion extends at least substantially the length of the sole and the heel.

In yet another aspect of the invention the longitudinally extending outer support portion extends around the heel and includes a feathered transitional portion.

DESCRIPTION OF THE PREFERRED EMBODIMENT

Figure 1:
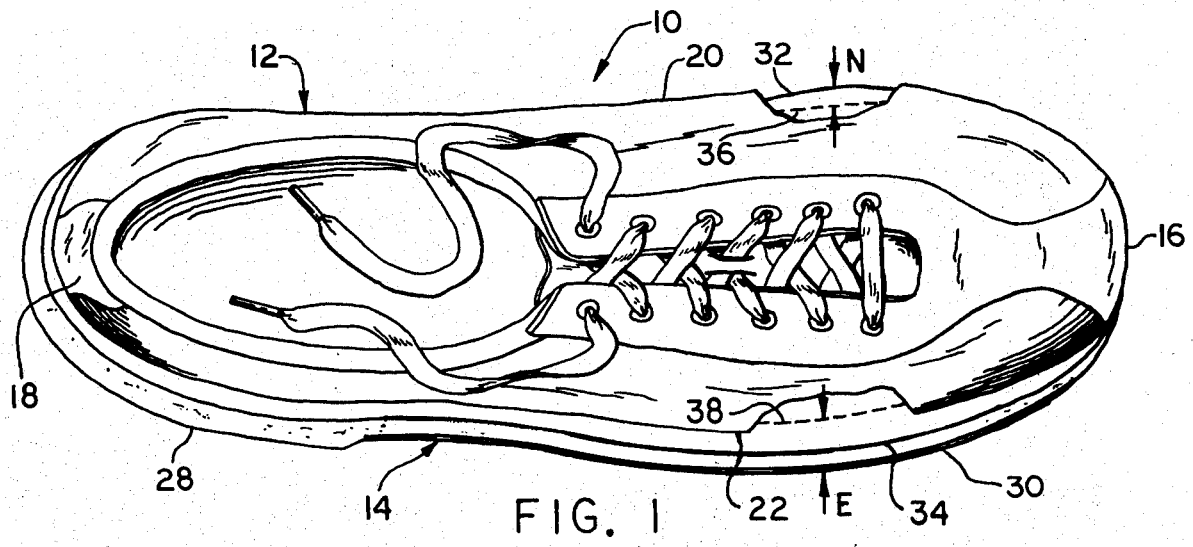
FIG. 1 is a top view of the bowling shoe.
Figure 2:
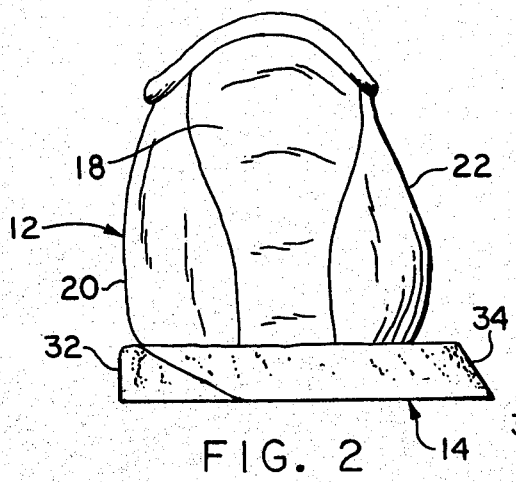
FIGS. 2 and 3 are rear and front views, respectively, of the bowling shoe.
Figure 3:
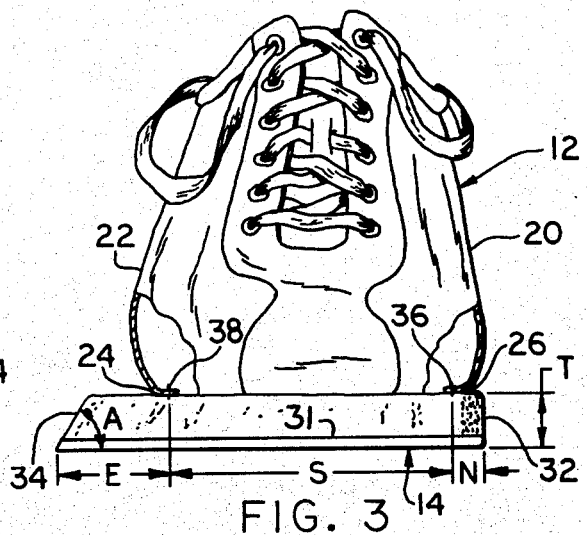

Referring now by reference numerals to the drawing and first to FIGS. 1 through 3 it will be understood that the bowling shoe 10 includes an upper portion 12 and a flexible lower portion 14.

In the embodiment shown, the upper portion 12 is conventional in that it includes front and rear ends 16 and 18 lace connected inner and outer sides 20 and 22. The upper portion 12 also includes a continuous lower margin providing oppositely disposed, longitudinally extending inner and outer side margin portions 24 and 26 respectively as shown in FIG. 3.

The lower portion 14 includes a heel 28 and a sole 30. In the embodiment shown the heel and sole are generally of solid rubber, the sole having an outer layer of leather indicated by numeral 31. The lower portion 14 provides oppositely disposed, longitudinally extending inner and outer side portions 32 and 34 attached to corresponding lower margin portions 24 and 26 respectively as by inner and outer lines of stitching 36 and 38 constituting attachment points for the upper and lower portions 12 and 14. Importantly the bowling shoe lower portion 14 projects outwardly on the outside of the shoe a considerably greater amount than is conventional or normal whereas the projection on the inside of the shoe is generally conventional.

Figure 5:
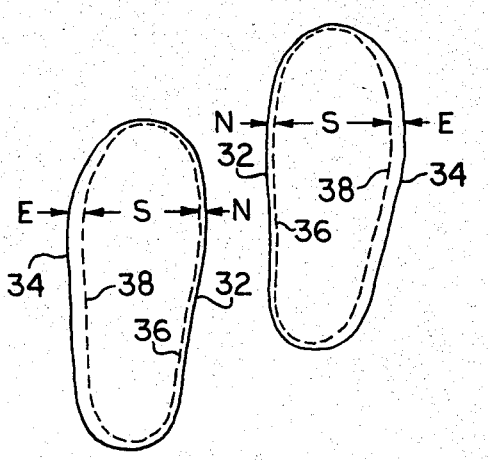
FIG. 5 shows a mirror-image pair of the bowling shoe.

This important structural arrangement of parts is clearly shown by reference to FIGS. 3 and 5. As shown in FIG. 3 the upper and lower portions 12 and 14 are attached as by inner and outer rows of stitching 36 and 38 respectively, constituting attachment lines. The transverse distance between the rows of stitching is shown by S. On the inside of the shoe 10 the inner side portion 32 projects outwardly beyond the row of stitching 36 and amount N. On the outside of the shoe 10 the outer side portion 34 projects outwardly beyond the row of stitching 38 by an amount E. In the embodiment shown, the projection N of the inner side portion 32 is about five percent (5%) of the transverse distance S between the rows of stitching 36 and 38. The projection E of the outer side portion 34 is between ten percent (10%) and thirty percent (30%) and good results have been found from a projection E of about one-half inch to three-quarter of one inch (¾"), based on a distance S between lines of stitching of about three to three and one half inches (3"–3½"), which is substantially greater than the conentional amount N of the order of one-eighth of one inch (⅛") to three-sixteenths of one inch (3/16"). This extended projection E is between one and two times the thickness T of the sole of the shoe which is of a conventional thickness of about one-half inch (½").

In the embodiment shown, the longitudinally extending outer side portion projection E includes an upper margin 40 and a lower margin 42, said lower margin extending outwardly of the upper margin to define a tapered edge. In the preferred embodiment the taper has an angle A of between thirty-five degrees (35°) and seventy-five degrees (75°) and good results have been obtained with a taper of about forty-five degrees (45°). The provision of a tapered edge reduces the weight of the projecting portion and also tends to distribute the forces on the said portion more evenly.

In the preferred embodiment, the projecting portion E extends substantially the full length of the shoe 10 and wraps around at the heel end, a feathered portion generally indicated by 50 providing a transition from the full projection E on the outer side of the shoe to the conventional projection N on the inner side of the shoe.

The projection E, by being on the outer side of the shoe, provides support for the outside edge of the foot of the wearer during play and improves bowling performance by providing the bowler with greater control of his forward foot. In order to avoid having special sets of shoes made for right-footed and left-footed players it is preferred that the shoes be identically constructed, and made in mirror-image pairs as shown in FIG. 5 each shoe having the leather outer layer 31. With this arrangement a purchasing player need only specify his particular size and receives the same pair of shoes, regardless of whether he is left-footed or right-footed.

Figure 4:
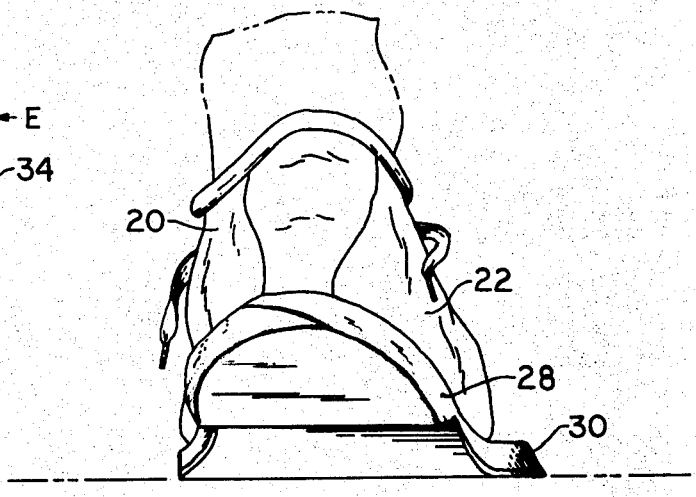
FIG. 4 is a perspective view of the bowling shoe with the heel raised.

FIG. 4 illustrates that the shoe can be used for various modes of play. It is anticipated that most players will use a flat-footed position during play, similar to that shown in FIG. 2, and this is facilitated by the extension of the projecting portion along the full length of the shoe 10. However, the shoe can also be used by players who raise the heel slightly during play and the projecting portion can be curtailed if desirable. However, the additionally projecting portion will extend at least a substantial part of the length of the sole.

In general, just prior to releasing the ball, the weight of the bowler is on the front end of the forward, sliding foot. Substantially simultaneously with ball release there is a weight shift to the heel tending to end sliding action. The leather sole 31 facilitates the sliding action and engagement of the rubber heel 14 facilitates the stopping action. By extending the projecting portion to the heel additional braking power is available to the bowler.

I claim as my invention:

1. A bowling shoe comprising:

(a) an upper portion including inner and outer sides providing oppositely disposed longitudinally extending inner and outer lower side margin portions, (b) a lower portion including a flexible sole having a substantially smooth side-facilitating underside, said lower portion including oppositely disposed longitudinally extending inner and outer side portions attached to corresponding lower side margin portions of the upper portion, (c) said longitudinally extending inner side portion projecting outwardly of the attached inner side margin portion at the point of attachment and said longitudinally extending outer side portion projecting outwardly of the attached outer side margin portion at the point of attachment, for at least a substantial portion of the length thereof, a substantially greater amount than said opposite inner side portion to provide support for the outside edge of the foot of the wearer during play said smooth underside facilitating sliding action of the shoe and said outer side projection facilitating support of the foot during said sliding action, and (d) said hole having a substantially constant thickness between oppositely disposed inner and outer margins at the point of attachment of the lower portion to the upper portion, and the longitudinally extending outer support portion including an upper margin and a lower margin said lower margin being disposed outwardly of said upper margin to define a tapered edge of the support portion to reduce weight and distribute forces more evenly.

2. A bowling shoe as defined in claim 1, in which:

(e) the outer side portion projection is substantially between ten percent (10%) to thirty percent (30%) of the transverse distance between oppositely disposed inner and outer margins at the point of attachment of the lower portion to the upper portion.

3. A bowling shoe as defined in claim 1, in which:

(e) the angle of the taper is substantially forty-five degrees (45°).

4. A bowling shoe as defined in claim 2, in which:

(f) the lower portion includes a heel and a sole, and (g) the longitudinally extending outer support portion extends at least substantially the length of the sole.

5. A bowling shoe as defined in claim 2, in which:

(f) the lower portion includes a heel and a sole, and (g) the longitudinally extending outer support portion of the lower portion extends substantially the length of the sole and the heel.

6. A bowling shoe as defined in claim 2, in which:

(f) the lower portion includes a heel and a sole, and (g) the longitudinally extending outer support portion extends around the heel and includes a feathered transistional portion.

7. A pair of bowling shoes, each shoe comprising:

(a) an upper portion inlcuding inner and outer sides providing oppositely disposed longitudinally extending inner and outer lower side margin portion, (b) a lower portion including a heel and a flexible sole having a substantially smooth slide-facilitating underside and oppositely disposed longitudinally extending inner and outer side portions attached to corresponding lower side margin portions of the upper portion, (c) said longitudinally extending inner side portion projecting outwardly of the attached inner side margin portion at the point of attachment and said longitudinally extending outer side portion projecting outwardly of the attached outer side margin portion at the point of attachment, for substantially the length of the heel and the sole, a greater amount than said opposite inner side portion, said projection being substantially between ten percent (10%) and thirty percent (30%) of the transverse distance between oppositely disposed inner and outer margins at the point of attachment of the lower portion to the upper portion to provide support for the outside edge of the foot of the wearer during play said smooth underside facilitating sliding action of the shoe and said outer side projection facilitating support of the foot during said slide action, and (d) said sole having a substantially constant thickness between oppositely disposed inner and outer margins at the point of attachment of the lower portion to the upper portion, and said longitudinally extending outer support portion including an upper margin and a lower margin, said lower margin being disposed outwardly of said upper margin to define a tapered edge of substantially forty-five degrees (45%) for the support portion.

8. A bowling shoe as defined in claim 1, in which: (e) the angle of the taper is substantially between (35°) and (75°).

* * * * *

UNITED STATES PATENT AND TRADEMARK OFFICE

CERTIFICATE OF CORRECTION

PATENT NO. : 4,468,870

DATED : September 4, 1984

INVENTOR(S) : Joseph E. Sternberg

It is certified that error appears in the above-identified patent and that said Letters Patent are hereby corrected as shown below:

Column 1, line 42 delete "the" and insert --ten--.

Column 3, line 46 delete "side" and insert --slide--.

Column 4, line 64 delete "(45%)" and insert --(45°)--.

Signed and Sealed this

*Twelfth* Day of *February 1985*

[SEAL]

*Attest:*

DONALD J. QUIGG

*Attesting Officer* *Acting Commissioner of Patents and Trademarks*